United States Patent [19]

Honzawa et al.

[11] 4,432,702

[45] Feb. 21, 1984

[54] SWASH PLATE TYPE COMPRESSOR

[75] Inventors: Yatsuhiro Honzawa, Kariya; Masuyoshi Moriyama; Hidekazu Iwamori, both of Obu, all of Japan

[73] Assignee: Kabushiki Kaisha Toyoda Jidoshokki Seisakusho, Aichi, Japan

[21] Appl. No.: 300,922

[22] Filed: Sep. 10, 1981

[30] Foreign Application Priority Data

Sep. 17, 1980 [JP] Japan ..... 55-133004[U]

[51] Int. Cl.[3] ..... F04B 1/16; F04B 1/18

[52] U.S. Cl. ..... 417/269

[58] Field of Search ..... 417/269

[56] References Cited

U.S. PATENT DOCUMENTS 3,801,227 4/1974 Nakayama ..... 417/269
4,070,136 1/1978 Nakayama ..... 417/269
4,321,019 3/1982 Dogawa ..... 417/269
4,360,321 11/1982 Copp ..... 417/269

FOREIGN PATENT DOCUMENTS 55-19916 2/1980 Japan ..... 417/269

*Primary Examiner*—William L. Freeh
*Attorney, Agent, or Firm*—Burgess, Ryan & Wayne

[57] ABSTRACT

A multi-piston swash plate type compressor in which there is provided an improved internal arrangement wherein the suction passageway in which a refrigerant gas is introduced from the exterior of the compressor is communicated with the suction chambers and the swash plate chamber by means of ports and through-holes whose locations are selected so as to prevent a liquid refrigerant from flowing into the suction chamber during stoppage of the compressor.

2 Claims, 6 Drawing Figures

SWASH PLATE TYPE COMPRESSOR

The present invention relates to a swash plate type compressor for use in air conditioning systems for vehicles.

U.S. Pat. No. 4,070,136 discloses a typical multipiston, double acting, single swash plate refrigerant gas compressor having a pair of horizontal axially aligned cylinder blocks forming a combined block.

The conventional swash plate type compressor of the type disclosed in the above-mentioned patent is provided with an internal arrangement in which a part of the refrigerant from the air conditioning system of a vehicle is introduced into a shaft sealing chamber of the compressor through an oil port provided near the bottom surface of a suction passage to lubricate and cool the surface of the shaft sealing device by the oil mist suspended in the refrigerant.

The swash plate type compressor of this type, however, has a disadvantage that a large quantity of liquid refrigerant is returned into the compressor when the temperature of the evaporator side of the air conditioning system becomes higher than that of the compressor due to variation of the ambient temperature, particularly, while the compressor is halted, so that the liquid refrigerant flows into the shaft sealing chamber to wash off the oil adhering to the sliding surfaces of the shaft sealing device, namely, the sealing surfaces or, when the compressor is provided with an oil pan at the lower part of the shaft sealing device, the oil retained in the oil pan is diluted by the liquid refrigerant resulting in the degradation of the sealing effect of the shaft sealing device.

Accordingly, an object of the present invention is to provide a swash plate type compressor capable of eliminating the disadvantage encountered by the conventional swash plate type compressor.

The present invention will be made more apparent in detail from the ensuing description, reference being made to the accompanying drawings wherein.

Figure 1:
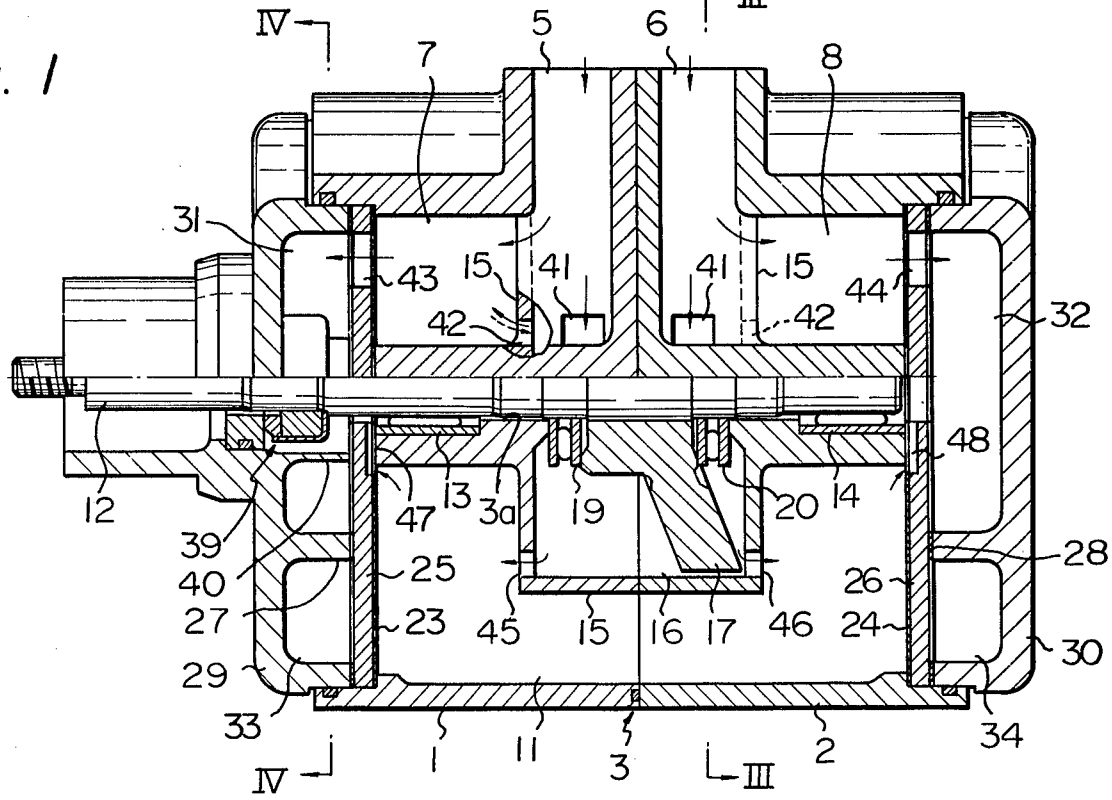
FIG. 1 is a sectional view of a swash plate type compressor according to the present invention, taken along the line I—I of FIG. 3.

Referring to FIGS. 1 through 4, a pair of cylinder blocks 1 and 2 symmetrical with respect to their joining plane are closely joined together to form a combined cylinder block 3 of a compressor. Three cylinder bores 1*a* and three cylinder bores 2*a* are formed within the cylinder blocks 1 and 2 respectively, and double-headed pistons 4 are fitted slidably in the respective cylinder bores 1*a* and 2*a*. Three cavities are formed in the spaces between the bores of the respective cylinder blocks 1 and 2. One of the cavities formed in the cylinder block 1 and also one of the cavities formed in the cylinder block 2 form suction passages 7 and 8, respectively, having suction ports 5 and 6, respectively, formed adjacent to the respective joining surfaces for receiving the returning refrigerant. Another cavity formed in both cylinder blocks 1 and 2 forms a discharge passage 10 having a discharge port 9 formed adjacent to the joining surface of the cylinder block 2. The last cavity formed in the cylinder blocks 1 and 2 forms an oil sump 11 extending across the cylinder blocks 1 and 2. A driving shaft 12 extends through the central bore 3*a* of the combined cylinder block 3 and is supported rotatably by bearings 13 and 14. A swash plate chamber 16 is defined by partition walls 15 at the central part of the combined cylinder block 3 and separated from the above-mentioned cavities. A swash plate 17 disposed within the swash plate chamber 16 is fixed to the driving shaft 12 by means of a spring pan 18 and supported by thrust bearings 19 and 20. Each piston 4 is engaged with the swash plate 17 through two pairs of shoes 21 and ball bearings 22 so as to be reciprocated according to the rotation of the swash plate 17.

Figure 2:
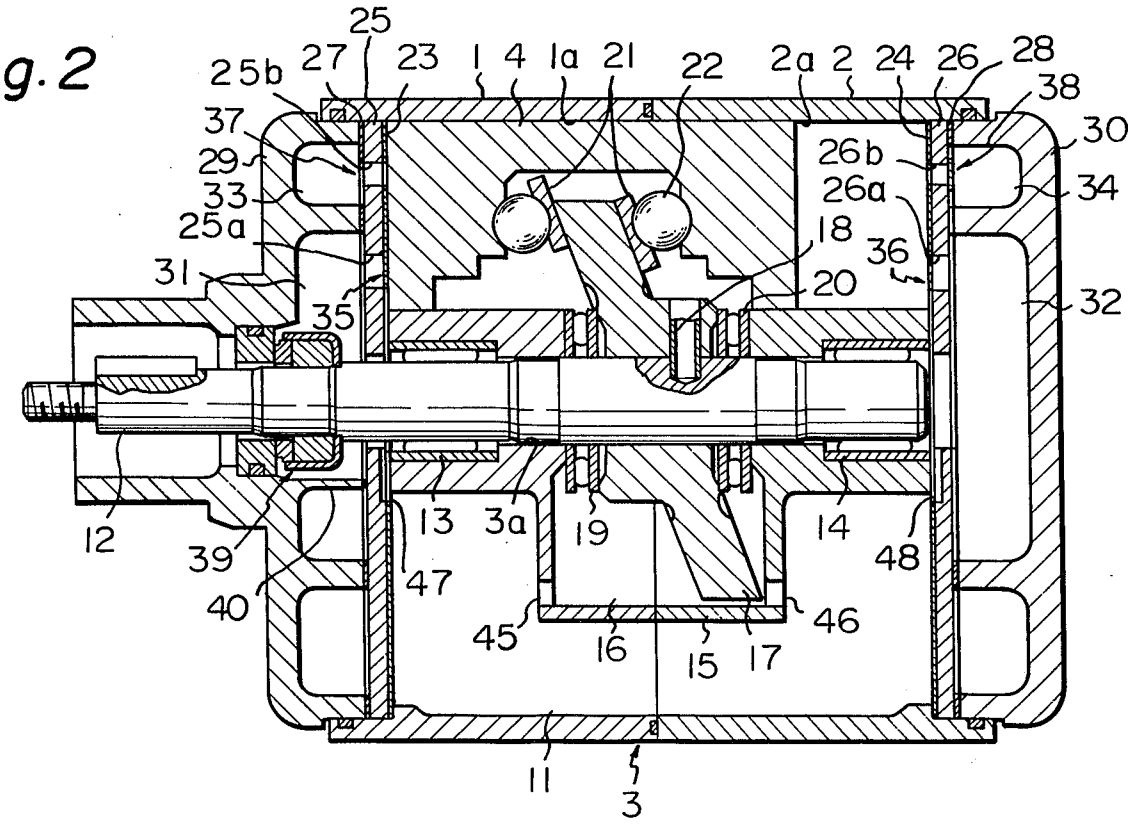
FIG. 2 is an another sectional view of the compressor of FIG. 1, taken along the line II—II of FIG. 3.
Figure 3:
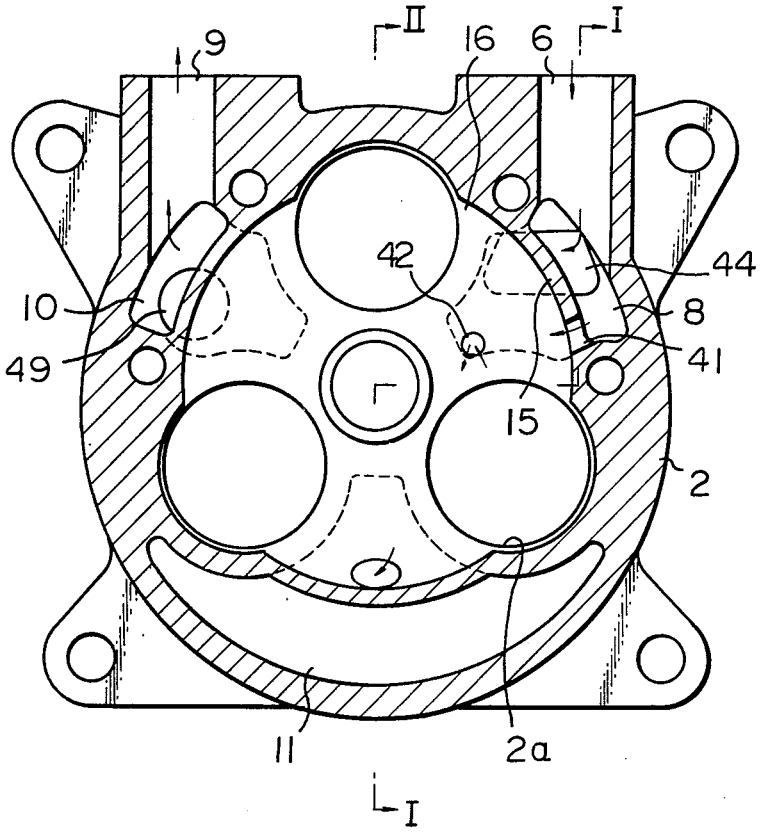
FIG. 3 is a vertical cross-sectional view of the compressor, taken along the line III—III of FIG. 1.
Figure 4:
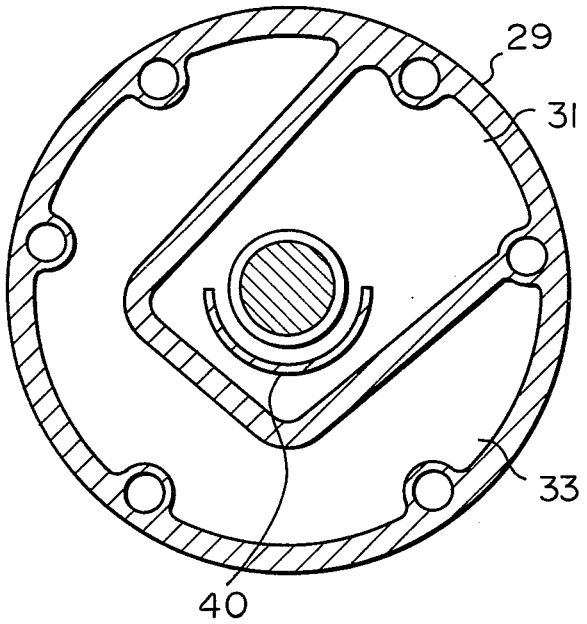
FIG. 4 is a vertical cross-sectional view of the compressor, taken along the line IV—IV of FIG. 1.

Front and rear housings 29 and 30 are joined to the respective end surfaces of the cylinder blocks 1 and 2 with suction valve sheets 23 and 24, valve plates 25 and 26 and gaskets 27 and 28 interposed therebetween. The housings 29 and 30 comprise suction chambers 31 and 32 and discharge chambers 33 and 34 respectively. The respective valve plates 25 and 26 have three suction ports 25*a* and 26*a* and three discharge ports 25*b* and 26*b* at positions opposite to the respective cylinder bores 1*a* and 2*a*. The valve plates 25 and 26, the associated valve sheets 23 and 24, and the discharge valve reeds cooperatively constitutes three suction valves 35 and 36 and together constitute three discharge valves 37 and 38. The driving shaft 12 penetrates through the front housing 29 at the central part thereof and projects outside as illustrated in FIGS. 1 and 2. The projecting end of the driving shaft 12 is operatively connected to a driving source. The driving shaft 12 and the front housing 29 are hermetically sealed from the outside by a shaft sealing element 39. An oil pan 40 for immersing the lower part of the shaft sealing element 39 is arranged inside the front housing 29 and formed as an integral part of the front housing 29. The shaft sealing chamber for disposing therein the element 39 is formed in common with the suction chamber 31 in this embodiment, however, the shaft sealing chamber and the suction chamber may be formed separately from each other.

Two pairs of inlet ports 41 and 42 are provided for the partition walls 15 separating the swash plate chamber 16 from the suction passages 7 and 8 to introduce a part of the returning refrigerant sucked in through the suction ports 5 and 6 into the swash plate chamber 16. At this stage, from the illustration of FIGS. 1 and 3, it should be understood that the first inlet ports 41 are disposed so as to be opposed to the suction ports 5 and 6, namely the respective axes of the suction ports 5 and 6 pass through the corresponding inlet ports 41. The two inlet ports 41 are disposed on the bottom surfaces of the suction passages 7 and 8 and located at positions radially outwardly remote from the central axis of the combined cylinder block 3. On the other hand, the second inlet ports 42 are disposed on the same bottom surfaces of the suction passages 7 and 8 but they are located at positions radially inwardly close to the central axis of the combined cylinder block 3. The suction passages 7 and 8 communicate with the suction chambers 31 and 32 respectively by means of through-holes 43 and 44, respectively, penetrating through the suction valve sheets 23 and 24 and valve plates 25 and 26. The through-holes 43 and 44 are disposed above the first and second inlet ports 41 and 42. In the drawings, reference numerals 45 and 46 designate: through holes formed at the lower part of the partition walls 15 separating the oil sump 11 and the swash plate chamber 16, 47 and 48: passages formed in the suction valve sheets 23 and 24 and valve plates 25 and 26 for connecting the oil sump 11 and the suction chambers 31 and 32, and 49: a through hole connecting the discharge passage 10 and the discharge chambers 33 and 34.

Figure 5:
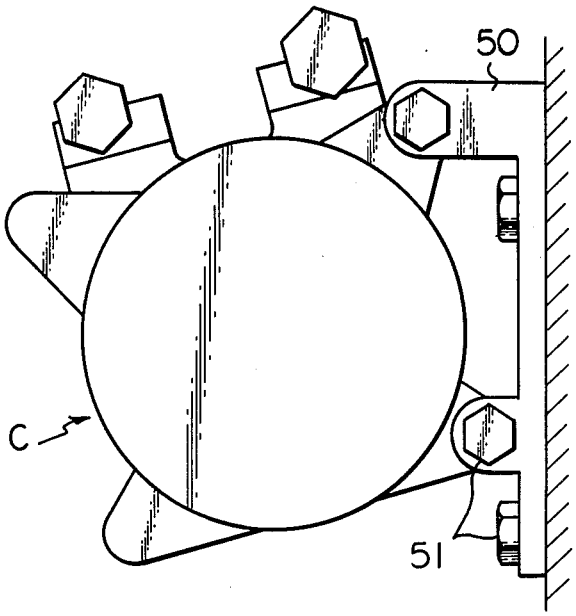
FIGS. 5 and 6 are illustrative views, respectively, showing the manner of mounting the compressor on a support provided in an engine compartment of a vehicle.
Figure 6:
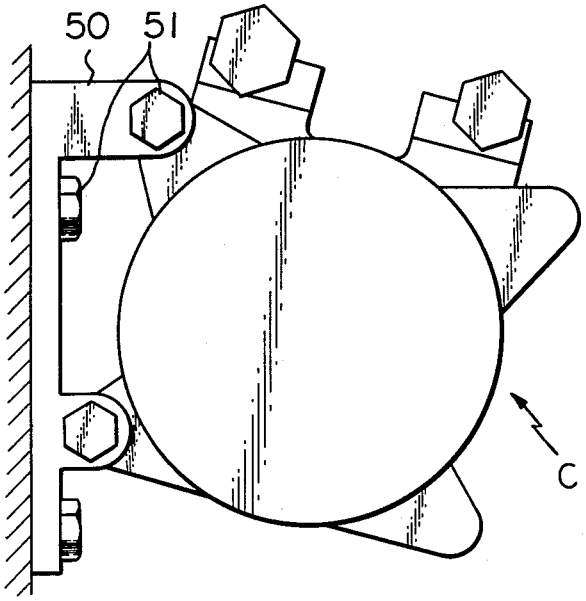

In mounting the swash plate type compressor thus constructed on a vehicle in the engine compartment, it is usual to attach the compressor appropriately to brackets 50 and fix with bolts 51 with the compressor slanted to the right or left as shown in FIGS. 5 and 6 in order to avoid interference with the adjacent parts in the engine compartment or to facilitate the piping operation. Accordingly, the first inlet port 41 is situated below the second inlet port 42 (FIG. 3) when the compressor is mounted on the engine with the combined cylinder block slanted to the right, whereas the second inlet port 42 is situated below the first inlet port 41 when the compressor is mounted with the combined cylinder block slanted to the left.

In the operation of the swash plate type compressor, the gaseous refrigerant returning from the evaporator flows into the suction passages 7 and 8 through the suction ports 5 and 6 respectively. A part of the returning gaseous refrigerant, which has a higher oil density containing more oil, flows into the swash plate chamber 16 through the first inlet ports 41 owing to its inertia to lubricate and cools the swash plate 17, shoes 21, ball bearings 22 and thrust bearings 19 and 20 contained in the swash plate chamber. The major part of the gaseous refrigerant having entered into the suction passages 7 and 8 successively flows into the suction chambers 31 and 32 through the holes 43 and 44 respectively. Therefore, the flow of the major part of the gaseous refrigerant induces the flow of the gaseous refrigerant from within the swash plate chamber 16 into the suction passages 7 and 8 through the second suction ports 42, thus facilitating the flow of a part of the returning gaseous refrigerant into the swash plate chamber 16 through the first inlet ports 41 and also improving the lubrication and cooling of the swash plate 17. On the other hand, the shaft sealing element 39 is sufficiently lubricated and cooled by the oil and gaseous refrigerant flowing into the suction chamber 31 formed in the front housing 29 and the oil contained in the oil pan 40, while sufficient oil films are formed over the sliding surfaces of the sealing element 39 to ensure a good sealing effect.

When the liquid refrigerant enters the compressor through the suction ports 5 and 6 while the compressor is stopped and the compressor is disposed with its combined cylinder block slanted to the right, the liquid refrigerant flows into the swash plate chamber 16 through the first inlet ports 41 disposed directly below the suction ports 5 and 6 respectively, and then flows into the oil sump 11. A part of the liquid refrigerant tends to flow into the suction chambers 31 and 32 through the suction passages 7 and 8 respectively, however, the flow of the liquid refrigerant is intercepted by the valve plates 25 and 26, since the through holes 43 and 44 are disposed at higher positions. Consequently, the liquid refrigerant having entered into the suction passages 7 and 8 stays in the suction passages 7 and 8, and finally flows into the coil sump 11 through the first inlet ports 41 disposed on the lowest level and the swash plate chamber 16. When a large quantity of the liquid refrigerant floods into the compressor, a part of the liquid refrigerant will flow into the swash plate chamber 16 through the second inlet ports 42 as indicated by an arrow drawn by broken lines in FIG. 1. When the compressor is disposed with its combined cylinder block slanted to the left, the liquid refrigerant flows into the swash plate chamber 16 and then into the oil sump 11 through the second inlet ports 42 as well as the first inlet ports 41, since the second inlet ports 42 are disposed below the first inlet ports 41.

Thus washing-off of the oil films covering the sliding surfaces of the shaft sealing element 39 and diluting of the oil contained in the oil pan 40 by the liquid refrigerant are prevented regardless of the inclination of the compressor, since the liquid refrigerant returning from the evaporator of the air conditioning system into the compressor is constrained to flow into the swash plate chamber 16 and prevented from flowing into the suction chamber 31.

It will be well understood from what has been described hereinbefore that, according to the present invention, two inlet ports opening into the swash plate chamber are formed on the bottom surface of each suction passage, one to the exterior and the other to the interior to constrain the liquid refrigerant to flow into the swash plate chamber regardless of the inclined disposition of the compressor, consequently, the liquid refrigerant is prevented from entering the space containng the shaft sealing element to that washing-off of the oil film covering the sliding surfaces of the shaft sealing element is prevented to ensure a good sealing effect. Furthermore, the introduction of the gaseous refrigerant into the swash plate chamber during the operation of the compressor is improved resulting in the improvement of lubrication and cooling of the swash plate and associated sliding members.

We claim:

1. A swash plate type compressor including: a pair of horizontal cylinder blocks jointed in axial alignment to form a horizontal combined cylinder block having therein a plurality of axial cylinder bores, said combined cylinder block further having a pair of suction ports formed adjacent to the joint of said pair of horizontal cylinder blocks for introducing a refrigerant gas into the combined cylinder block; front and rear housing attached to the front and rear ends of said combined cylinder block, via valve plates, respectively, each said housing having therein a suction chamber and a discharge chamber; a driving shaft extending axially through the center of said horizontal combined cylinder block, said driving shaft being rotatably supported in said combined cylinder block; a swash plate fixedly mounted on said driving shaft and received in a swash plate chamber defined in said combined cylinder block, and; a plurality of compressor pistons engaged with said swash plate and being reciprocable within said respective cylinder bores of said horizontal combined cylinder block, wherein at least one of the cavities formed between said neighbouring cylinder bores of said horizontal combined cylinder block is provided as a horizontal suction passageway, at least one pair of inlet ports are formed in the bottom surface of said suction passageway for communicating said suction passageway with said swash plate chamber, one being located at a position radially outwardly remote from the center of said horizontal combined cylinder block and the other being located at another position radially inwardly close to the center of said horizontal combined cylinder block, and through-holes for connecting said suction passageway and said suction chambers of said front and rear housings are provided above said pair of inlet ports, respectively.

2. A swash plate type compressor as set forth in claim 1, wherein said inlet port that is located at a position radially outwardly remote from the center of said horizontal combined cylinder block is disposed in substantial alignment with one of said suction ports.

* * * * *